US009051786B2

(12) United States Patent
Lambert et al.

(10) Patent No.: US 9,051,786 B2
(45) Date of Patent: Jun. 9, 2015

(54) DIAMOND IMPREGNATED BIT WITH AGGRESSIVE FACE PROFILE

(75) Inventors: Christian M. Lambert, Draper, UT (US); Michael D. Rupp, Murray, UT (US)

(73) Assignee: Longyear TM, Inc., South Jordan, UT (US)

( * ) Notice: Subject to any disclaimer, the term of this patent is extended or adjusted under 35 U.S.C. 154(b) by 640 days.

(21) Appl. No.: 12/857,331

(22) Filed: Aug. 16, 2010

(65) Prior Publication Data

US 2011/0036640 A1 Feb. 17, 2011

Related U.S. Application Data

(60) Provisional application No. 61/233,952, filed on Aug. 14, 2009.

(51) Int. Cl.

| | |
|---|---|
| ***E21B 10/48*** | (2006.01) |
| ***E21B 10/567*** | (2006.01) |
| ***E21B 10/02*** | (2006.01) |

(52) U.S. Cl.

CPC ..... *E21B 10/02* (2013.01); *Y10T 29/4998* (2015.01); *E21B 10/48* (2013.01)

(58) Field of Classification Search

CPC ..... E21B 10/02; E21B 10/48; E21B 10/567
USPC ..... 175/403, 405.1; 166/242.1
See application file for complete search history.

(56) References Cited

U.S. PATENT DOCUMENTS

| | | | | |
|---|---|---|---|---|
| 348,782 A | | 9/1886 | Sawyer | |
| 2,147,843 A | | 2/1939 | Jamar et al. | |
| 2,966,949 A | | 1/1961 | Wepsala, Jr. | |
| 3,127,715 A | | 4/1964 | Christensen | |
| 3,306,380 A | * | 2/1967 | Warren et al. | 175/405.1 |
| D210,975 S | | 5/1968 | Blau | |
| 3,440,773 A | | 4/1969 | Hawkes | |
| 3,537,538 A | * | 11/1970 | Generoux | 175/405.1 |
| 4,128,136 A | * | 12/1978 | Generoux | 175/405.1 |
| 4,190,126 A | * | 2/1980 | Kabashima | 175/426 |
| 4,202,420 A | * | 5/1980 | Peetz et al. | 175/395 |
| 4,208,154 A | | 6/1980 | Gundy | |
| 4,221,270 A | | 9/1980 | Vezirian | |
| 4,499,959 A | * | 2/1985 | Grappendorf et al. | 175/405.1 |

(Continued)

FOREIGN PATENT DOCUMENTS

| | | |
|---|---|---|
| AU | 2010282270 B2 | 2/2015 |
| CA | 2762861 | 8/2010 |
| CN | 102472082 A | 5/2012 |
| EP | 0086086 A2 | 8/1983 |
| EP | 0311422 A1 | 4/1989 |
| WO | WO 2011/020111 | 2/2011 |

OTHER PUBLICATIONS

Notice of Allowance dated Sep. 28, 2010 from U.S. Appl. No. 29/354,596, filed Jan. 26, 2010 (4 pages).

(Continued)

*Primary Examiner* — Catherine Loikith

(74) *Attorney, Agent, or Firm* — Ballard Spahr LLP

(57) ABSTRACT

A drill bit includes a crown defining a central axis. The crown includes at least one segment. The segment includes a planar portion and a plurality of surface features continuous with and extending away from the planar portion. The surface features are discontinuous within the segment with respect to a first arced path defined at a first radial distance from the central axis.

18 Claims, 5 Drawing Sheets

(56) References Cited

U.S. PATENT DOCUMENTS

| | | | | |
|---|---|---|---|---|
| 4,552,232 | A * | 11/1985 | Frear | 175/337 |
| 4,628,549 | A | 12/1986 | Lazar | |
| 5,025,871 | A | 6/1991 | Stewart et al. | |
| D342,270 | S | 12/1993 | Kwang | |
| D416,741 | S | 11/1999 | Denney et al. | |
| 6,029,962 | A | 2/2000 | Shorten et al. | |
| 6,193,000 | B1 * | 2/2001 | Caraway et al. | 175/431 |
| 6,293,854 | B1 | 9/2001 | Kimura et al. | |
| D466,139 | S | 11/2002 | Kim et al. | |
| D467,590 | S | 12/2002 | Walker | |
| D478,761 | S | 8/2003 | Robbins, III | |
| D559,510 | S | 1/2008 | McClaskie | |
| 7,490,533 | B2 | 2/2009 | Dehn et al. | |
| 2005/0016775 | A1 | 1/2005 | Hiranuma et al. | |
| 2005/0279533 | A1 | 12/2005 | Corica | |
| 2006/0272571 | A1 | 12/2006 | Cho | |
| 2007/0246266 | A1 | 10/2007 | Larbo | |
| 2009/0078469 | A1 | 3/2009 | Drivdahl et al. | |
| 2009/0129873 | A1 | 5/2009 | Grace et al. | |

OTHER PUBLICATIONS

Supplemental Notice of Allowability dated Oct. 15, 2010 from U.S. Appl. No. 29/354,596, filed Jan. 26, 2010 (6 pages).

International Search Report dated Mar. 25, 2011 from PCT Application No. PCT/US2010/045650 filed Aug. 16, 2010 (3 pages).

Office Action dated Jun. 23, 2010 from U.S. Appl. No. 29/354,595, filed Jan. 26, 2010 (8 pages).

Office Action dated Jun. 23, 2010 from U.S. Appl. No. 29/354,596, filed Jan. 26, 2010 (6 pages).

Office Action dated Jun. 23, 2010 from U.S. Appl. No. 29/354,597, filed Jan. 26, 2010 (6 pages).

Longyear Europe, Diamond Products Sales Manual, May 26, 1993, pp. 1-3, T-18, T19.

Boart Longyear Company, Longyear Bits and Accessories, Global Product Catalogue, Aug. 2009, 56 pages, Salt Lake City, Utah.

Issue Notification dated Dec. 22, 2010 from U.S. Appl. No. 29/354,596, filed Jan. 26, 2010 (1 page).

International Preliminary Report on Patentability issued Feb. 14, 2012 for International Patent Application No. PCT/US2010/045650, which was published as WO 2011/020111 on Feb. 17, 2011 (Inventor—Lambert; Applicant—Longyear TM, Inc.) (pp. 1-4).

Written Opinion issued Mar. 25, 2011 for International Patent Application No. PCT/US2010/045650, which was published as WO 2011/020111 on Feb. 17. 2011 (Inventor—Lambert; Applicant—Longyear TM, Inc.) (pp. 1-3).

Notice of Acceptance mailed Feb. 5, 2015 for Australian Application No. 2010/282270 filed Aug. 16, 2010.

* cited by examiner

DIAMOND IMPREGNATED BIT WITH AGGRESSIVE FACE PROFILE

CROSS-REFERENCE TO RELATED APPLICATIONS

This application claims the benefit of prior-filed U.S. Provisional Application 61/233,952 filed Aug. 14, 2009 and entitled "DIAMOND IMPREGNATED BIT WITH AGGRESSIVE FACE PROFILE," the disclosure of which is hereby incorporated by reference in its entirety.

BACKGROUND

1. The Field of the Invention

This application relates generally to drill bits and methods of making and using such drill bits. In particular, this application relates to impregnated drill bits with aggressive face-profiles, as well as to methods for making and using such drill bits.

2. The Relevant Technology

While many different drilling processes are used for a variety of purposes, in most drilling processes a drill head applies axial forces (feed pressure) and rotational forces to drive a drill bit into a formation. More specifically, a bit is often attached to a drill string, which is a series of connected drill rods coupled to the drill head. The drill rods are assembled section by section as the drill head moves and drives the drill string deeper into the desired sub-surface formation. One type of drilling process, rotary drilling, involves positioning a rotary cutting bit at the end of the drill string. The rotary cutting bit often includes cutters that are distributed across the face of the rotary cutting bit.

Bits can be impregnated with diamonds so that they can be used to cut hard formations and/or to increase the durability of the bit. The part of the bit that performs the cutting action, sometimes referred to as a face, is generally formed of a matrix that contains a powdered metal or a hard particulate material, such as tungsten carbide. This material is sometimes infiltrated with a binder, such as a copper alloy. The matrix and binder associated with the face are mixed with diamond crystals or some other form of abrasive cutting media. As the tool grinds and cuts the desired materials, the matrix and binder erode and expose new layers of the diamond crystal (or other cutting media) so that a sharp surface is always available for the cutting process.

In order for a new bit to drill a formation, some portion of the matrix and binder often must be eroded away in order to expose a sufficient amount of the diamond to allow the diamond to cut the formation. Accordingly, often there is a break-in period for a bit after the bit is placed in rotating contact with a formation as the matrix wears to expose a sufficient amount of the diamonds for effective cutting. Such a process can increase the time associated with the corresponding drilling operations, and hence costs. This delay can be exacerbated if the bit is used in relatively soft formations as it may require a relatively long time to expose sufficient diamonds for effective cutting.

One approach to expose sufficient diamonds rapidly is to prepare the surface of the bit, such as by performing an initial grinding operation. In such an operation, the bit can efficiently cut as it rotates shortly after the bit is placed in contact with the formation. However, such a process still introduces additional time to the entire drilling operation, as well as the complexity associated with an additional step. Alternatively, this grinding process can be performed by the manufacturer of the bit, adding additional process time and cost.

BRIEF SUMMARY OF THE INVENTION

A drill bit includes a crown defining a central axis. The crown includes at least one segment. The segment includes a planar portion and a plurality of surface features continuous with and extending away from the planar portion. The surface features are discontinuous within the segment with respect to a first arced path defined at a first radial distance from the central axis.

In order for a new bit to drill a formation, some portion of the matrix and binder often must be eroded away in order to expose a sufficient amount of the diamond to allow the diamond to cut the formation. Accordingly, often there is a break-in period for a bit after the bit is placed in rotating contact with a formation as the matrix wears to expose a sufficient amount of the diamonds for effective cutting. Such a process can increase the time associated with the corresponding drilling operations, and hence costs. This delay can be exacerbated if the bit is used in relatively soft formations as it may require a relatively long time to expose sufficient diamonds for effective cutting.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The following description can be better understood in light of the Figures, in which.

Figure 1:
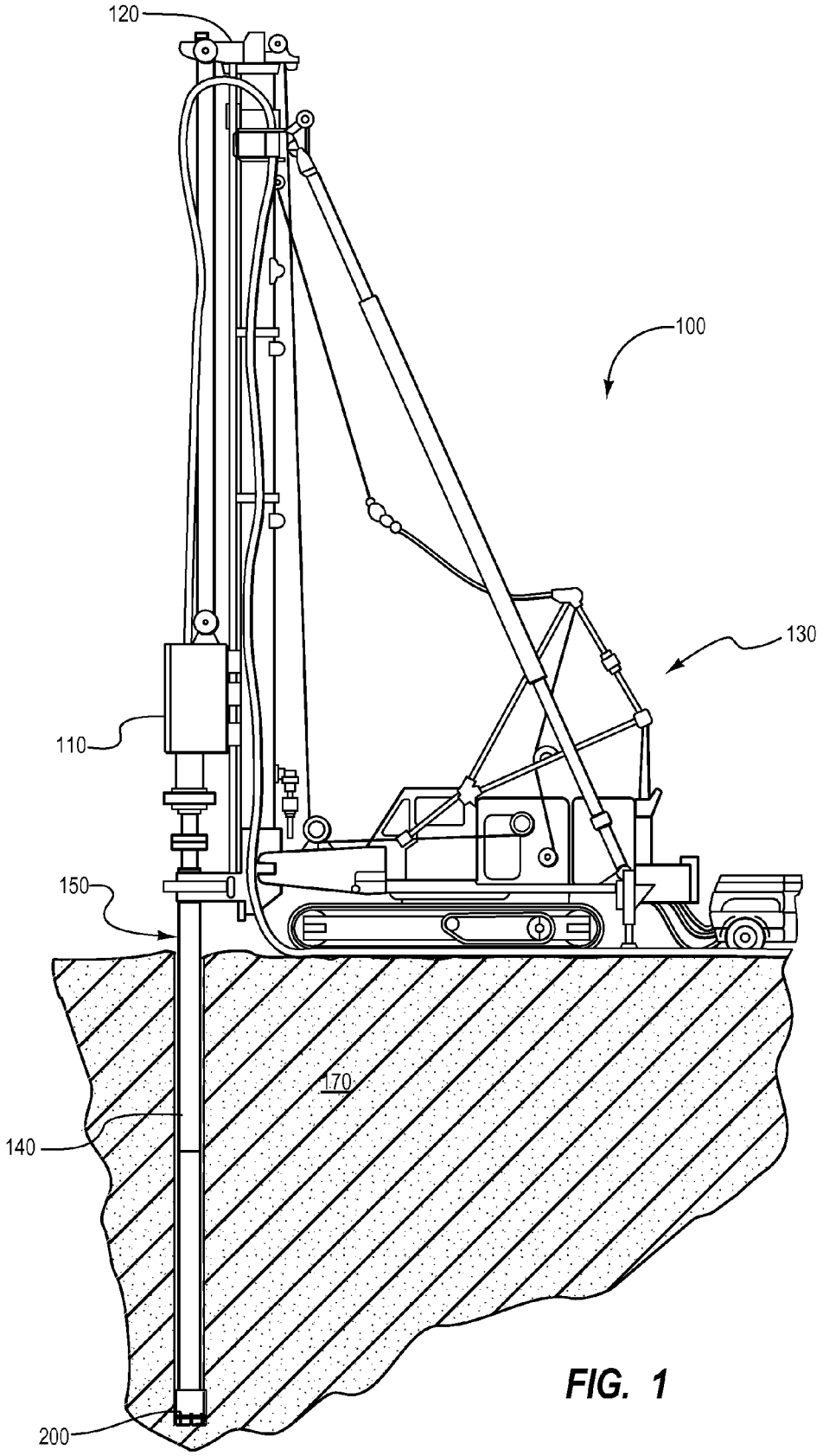
FIG. 1 illustrates a drilling system according to one example.

Together with the following description, the Figures demonstrate and explain the principles of the apparatus and methods for using the drill bits. In the Figures, the thickness and configuration of components may be exaggerated for clarity. The same reference numerals in different Figures represent the same component.

DETAILED DESCRIPTION

Drill bits, methods of using drill bits, and methods of producing drill bits are described herein. In at least one example, the drill bits include a cutting face with a generally planar surface and surface features continuously formed with and extending from the planar surface. The surface features have gaps between them on the generally planar surface that cause the surface features to apply variable contact stresses to a formation as the drill bit rotates. Such a configuration can allow the drill bit to quickly fatigue the material, which in turn can cause the material to break away from the adjacent material more quickly. Accordingly, the surface features can increase the cutting speed of the drill bit.

In at least one example, the cutting face can be divided into segments in which adjacent segments are separated by water channels defined in the otherwise generally planar portion of the cutting face. In such an example, one or more of the segments can include surface features that are discontinuous or are otherwise separated by gaps in an arc on the cutting face which is defined at a given radial location. One such configuration can be provided by cutting features that are partially ellipsoid in shape, such as generally hemispherical.

The following description supplies specific details in order to provide a thorough understanding. Nevertheless, the skilled artisan would understand that the apparatus and associated methods of using the apparatus can be implemented and used without employing these specific details. Indeed, the apparatus and associated methods can be placed into practice by modifying the illustrated apparatus and associated methods and can be used in conjunction with any other apparatus and techniques conventionally used in the industry. For example, while the description below focuses on rotary drill bits for obtaining core samples, the apparatus and associated methods could be equally applied in other drilling apparatuses and processes, such as diamond core drill bits and other vibratory and/or percussive drill systems.

FIG. 1 illustrates a drilling system 100 that includes a drill head assembly 110. The drill head assembly 110 can be coupled to a mast 120 that in turn is coupled to a drill rig 130. The drill head assembly 110 is configured to have a drill rod 140 coupled thereto. The drill rod 140 can in turn couple with additional drill rods to form a drill string 150. In turn, the drill string 150 can be coupled to a drill bit 200 configured to interface with the material to be drilled, such as a formation 170.

In at least one example, the drill head assembly 110 is configured to rotate the drill string 150. In particular, the rotational rate of the drill string 150 can be varied as desired during the drilling process. Further, the drill head assembly 110 can be configured to translate relative to the mast 120 to apply an axial force to the drill head assembly 110 to force the drill bit 200 into the formation 170 during a drill process.

In at least one example, the drill bit 200 includes a cutting face with a generally planar surface and surface features continuously formed with and extending from the planar surface. The surface features have gaps between them on the generally planar surface that cause the surface features to apply variable contact stresses to a formation as the drill bit 200 rotates. Such a configuration can allow the drill bit 200 to quickly fatigue the material, which in turn can cause the material to break away from the adjacent material more quickly. Accordingly, the surface features can increase the cutting speed of the drill bit 200.

In at least one example, the cutting face can be divided into segments in which adjacent segments are separated by water channels defined in the otherwise generally planar portion of the cutting face. In such an example, one or more of the segments can include surface features that are discontinuous or are otherwise separated by gaps in an arc on the cutting face that is defined at a given radial location. One such configuration can be provided by cutting features that are partially ellipsoid in shape, such as generally hemispherical. One exemplary drill bit will now be discussed in more detail with reference to FIG. 2.

Figure 2:
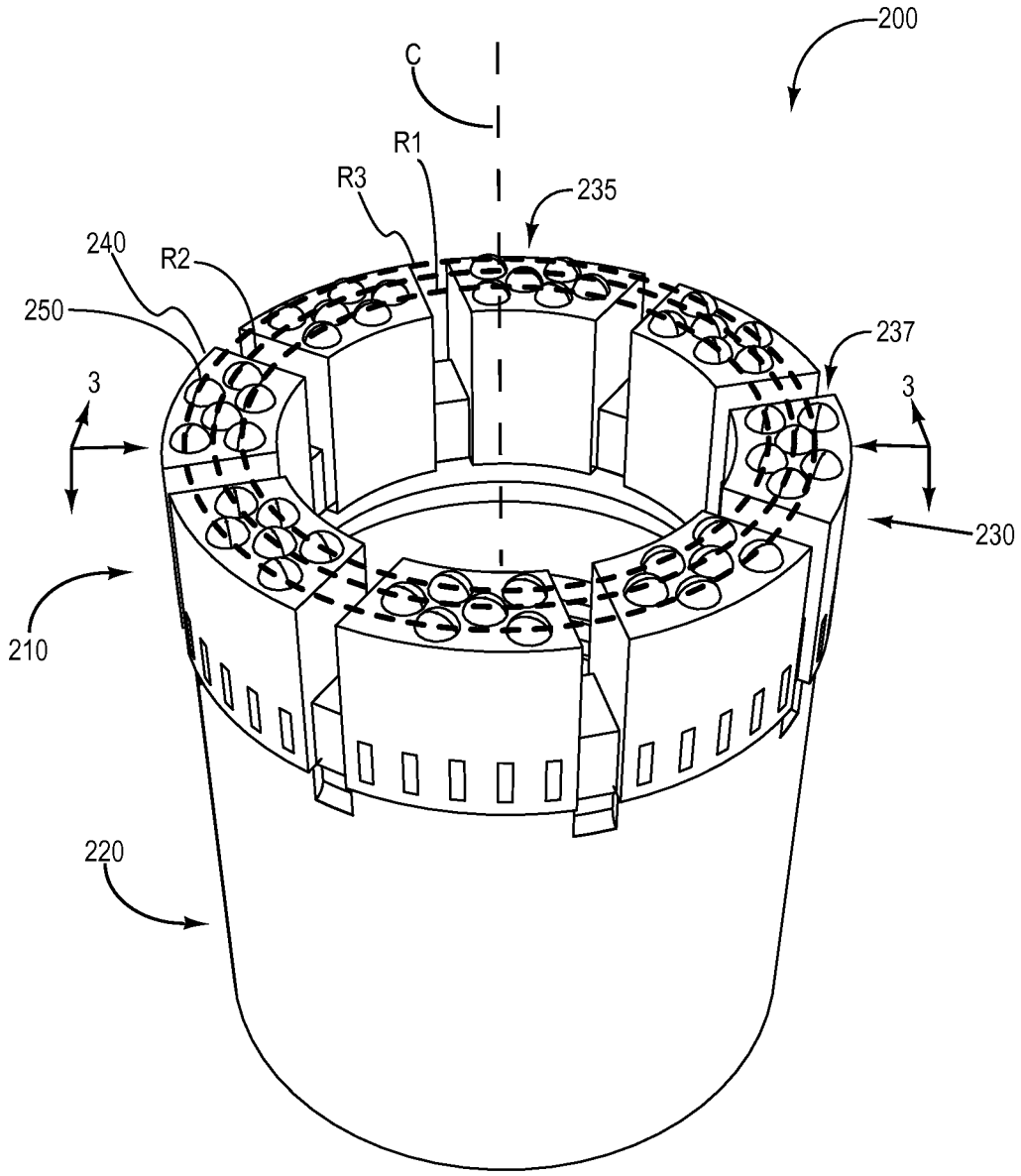
FIG. 2 illustrates a perspective view of a drill bit according to one example.

FIG. 2 illustrates a perspective view of the drill bit 200 introduced with reference to FIG. 1. The crown 210 and/or the drill bit 200 define a central axis C. As described herein, radial aspects, orientations, or measures will be described as being transverse to the central axis C. As illustrated in FIG. 2, the drill bit 200 generally includes a crown 210 secured to a shank 220.

The crown 210 may also include a cutting face 230 formed from a plurality of segments 235. The segments 235 can be separated by water channels 237 formed in the crown 210 that extend radially through adjacent segments 235. Each segment 235 includes a generally planar portion 240 and a plurality of surface features 250 continuous with and extending away from the planar portion 240 of the cutting face 230.

A portion of the surface features 250 that contacts a formation can have an at least partially arcuate cross-sectional shape. In at least one example, the surface features 250 can have a three-dimensionally arcuate cross-sectional shape. Such a configuration can result in a surface feature that is some portion of an ellipsoid. Such shapes can include, without limitation, surface features that are shaped as some portion of a sphere or a spheroid. One example of a partial spheroid is a hemisphere.

Such a configuration results in discontinuously raised portions at various radial positions on the segments 235. The surface features 250 can be arranged in any number of configurations that include repeating patterns and/or random arrangements on the segments 235. In the example shown, the surface features 250 are arranged at three radial positions R1, R2, R3 on each of the segments 235. In other examples, the more or less surface features 250 can be arranged at any number of radial positions. The number of radial positions can also vary between segments. Further, the surface features 250 can also be randomly and/or unevenly distributed about the cutting face 230 as desired.

For ease of reference, the radial positions shown in FIG. 2 will be described. In the illustrated example, the surface features 250 are shown having approximately the same widths or diameters at each radial position. For example, surface features 250 positioned at radial position R1 have generally the same width or diameter as surface features 250 at radial positions R2 and R3. However, the surface features 250 may also have different diameters at each of the radial positions R2 and R3. In at least one example, surfaces features 250 at R1 may have a larger diameter than surface features 250 at radial position R2 and/or R3. Similarly, surface features 250 at radial position R2 may have a larger diameter than surface features 250 positioned at radial position R3. Accordingly, surface features 250 positioned nearer the central axis C may have larger diameters than those positioned further from the central axis C. It will be appreciated that the inverse may also be true as desired or that diameters of the surface features may vary in any number of ways.

As also shown in FIG. 2, the surface features 250 may be positioned at an angular offset with respect to surface features 250 at adjacent radial positions. In particular, surface features 250 at radial position R2 may be angularly offset from surface features at adjacent radial positions R1 and R2.

As shown in FIG. 2, the configuration of the segment 235 results in gaps or spaces between adjacent surface features 250 at a given radial position. Such a configuration results in discontinuous contact at a given location on a formation as the drill bit 200 rotates. This in turn can cause or generate fluctuating stress at that location, which can cause the material at that location to fatigue and fail rapidly, thereby causing rapid cutting of the formation. In particular, in at least one example, abrasive particles embedded in a matrix cut the material. One exemplary configuration of a matrix and abrasive materials will now be discussed in more detail, followed by a discussion of a cutting operation using circumferentially discontinuous surface features.

Figure 3:
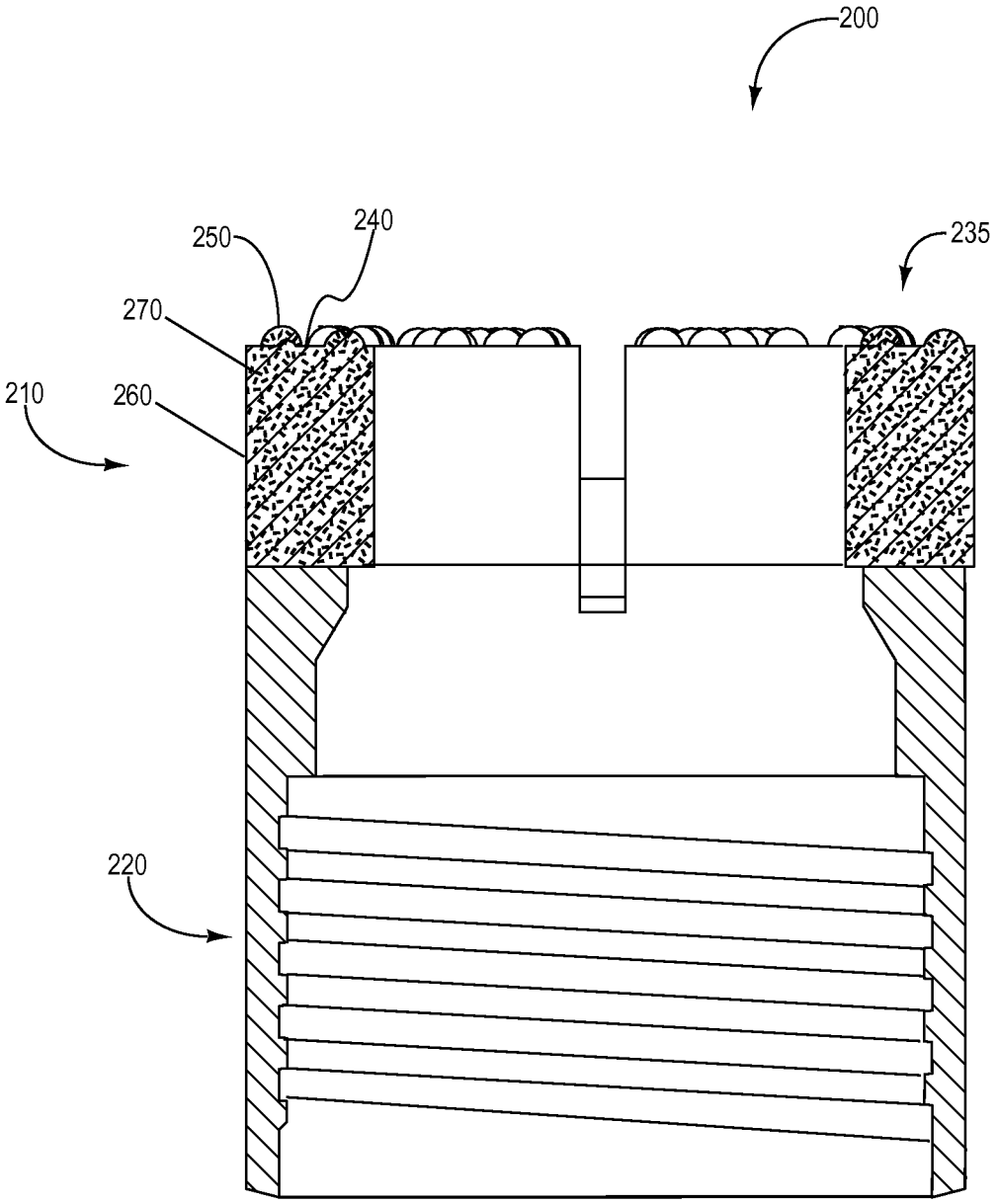
FIG. 3 illustrates a cross-sectional view of a drill bit according to one example.

FIG. 3 illustrates a cross-sectional view of the drill bit 200 taken along section 3-3 of FIG. 2. FIG. 3 illustrates that the surface features 250 extend from and are integrally formed with planar portion 240. As a result, the surface features 250 and planar portion 240 form a single integrated crown 210. As illustrated in FIG. 3, both the planar portion 240 and the surface features 250 include a matrix material 260 bonded to the shank 220 by a binder material (not shown). Further, as shown in FIG. 3, the matrix material 260 can continuously form a substantial portion of the outer shape of the crown 210.

Abrasive particles 270, such as synthetic diamond particles, other types of diamonds, and/or other types of abrasive particles are distributed within and supported by the matrix 260. In at least one example, the distribution of abrasive particles 270 is substantially uniform between the surface features 250 and the crown 210. Such a configuration can reduce or eliminate a transition area or boundary between the crown 210 and the surface features 250.

Figure 4A:
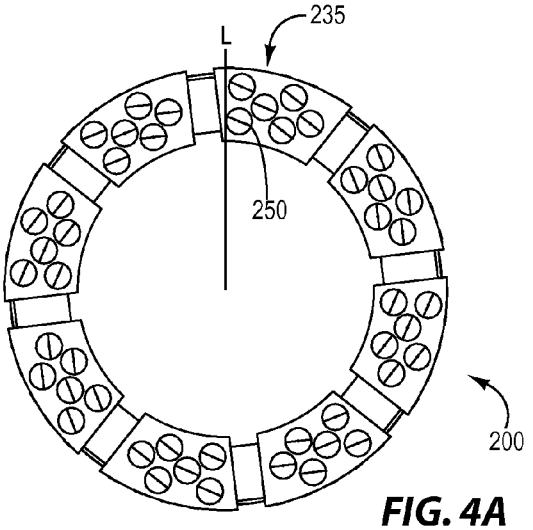
FIG. 4A illustrates an end view of a drill bit according to one example.
Figure 4B:
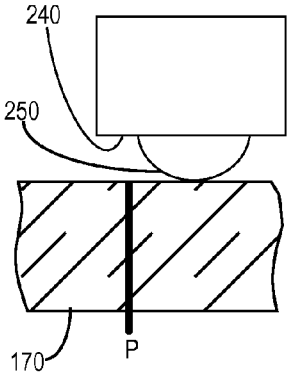
FIG. 4B illustrates an exemplary interaction between a surface feature and a formation at a reference point according to one example.
Figure 5A:
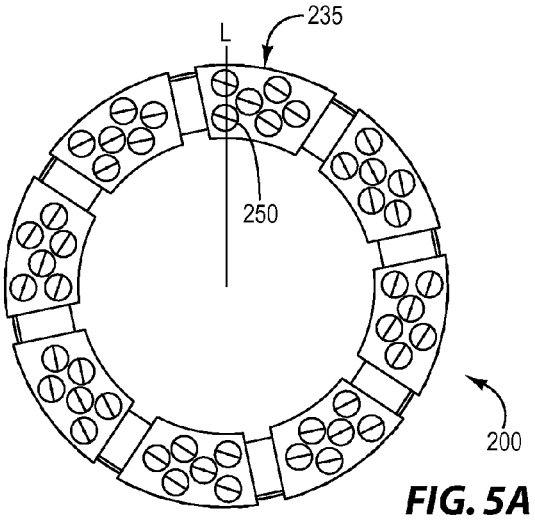
FIG. 5A illustrates an end view of a drill bit according to one example.
Figure 5B:
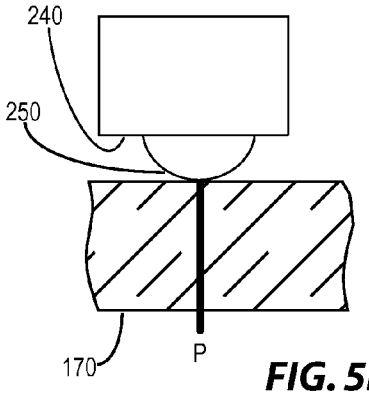
FIG. 5B illustrates an exemplary interaction between a surface feature and a formation at a reference point according to one example.
Figure 6A:
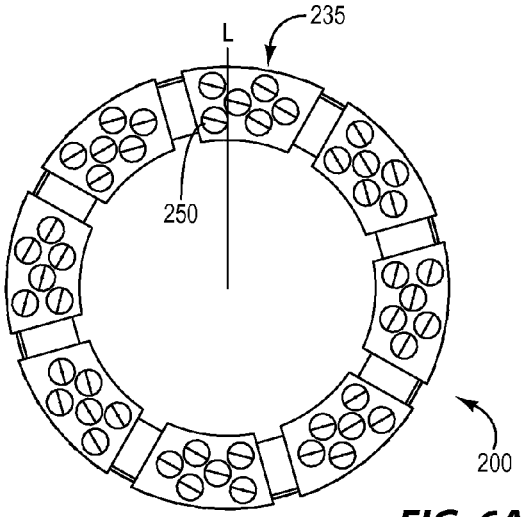
FIG. 6A illustrates an end view of a drill bit according to one example.
Figure 6B:
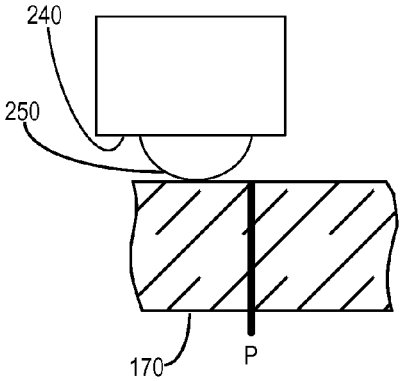
FIG. 6B illustrates an exemplary interaction between a surface feature and a formation at a reference point according to one example.

FIGS. 4A-6B illustrates the drill bit 200 in close detail in a drilling environment within a representative formation 170 and with respect to a reference point P on the formation 170. In particular, FIGS. 4A, 5A, and 6A illustrate the rotation of the drill bit 200 relative to a stationary point P and FIGS. 4B, 5B, and 6B illustrate the interaction with a single surface feature 250 with the formation 170 and with the reference point P. Line L illustrates a stationary line, which is referenced to show angular displacement of the drill bit 200 and reference point P is on the line L.

As the drill bit 200 rotates, successive surface features 250 on each segment 235 at a given radial position on the drill bit 200 come in and out of contact with the reference point P. An exemplary interaction is illustrated in FIGS. 4B, 5B, and 6B. In particular, in the position shown in FIG. 4B a relatively small area, if any, of the surface feature 250 is in contact with the reference point P as a gap between surface features 250 is positioned at an axially proximal position relative to the reference point P. In such a position, the contact stress the surface feature 250 (FIG. 4B) applies to the reference point can be at or near a minimum.

Continued rotation of the drill bit 200 and an axial force applied to the drill bit 200 causes increasing contact between the surface feature 250 and the reference point P until the contact is at a maximum as shown in FIG. 5B. The increasing contact results in increasing contact stress until a center of the surface feature 250 is axially aligned with the reference point P. At this point, the contact stress the surface feature 250 applies to the reference point P can be at or near a maximum value.

Continued rotation to the relative positions shown in FIGS. 6A and 6B results in decreasing contact and a corresponding decrease in contact stress until the contact stress returns to a minimum while a gap between adjacent features is axially aligned with the point. As a result, the configuration of the drill bit 200 allows the drill bit 200 to apply varying contact stress at various radial positions within each segment 235, cyclically varying the contact stresses applied by each segment 235. Varying contact stresses can result in fatigue at those various locations, which in turn can cause the material to fail more quickly than a relatively constant contact stress. Such a configuration can result in the drill bit 200 cutting more quickly than other bits.

Figure 7:
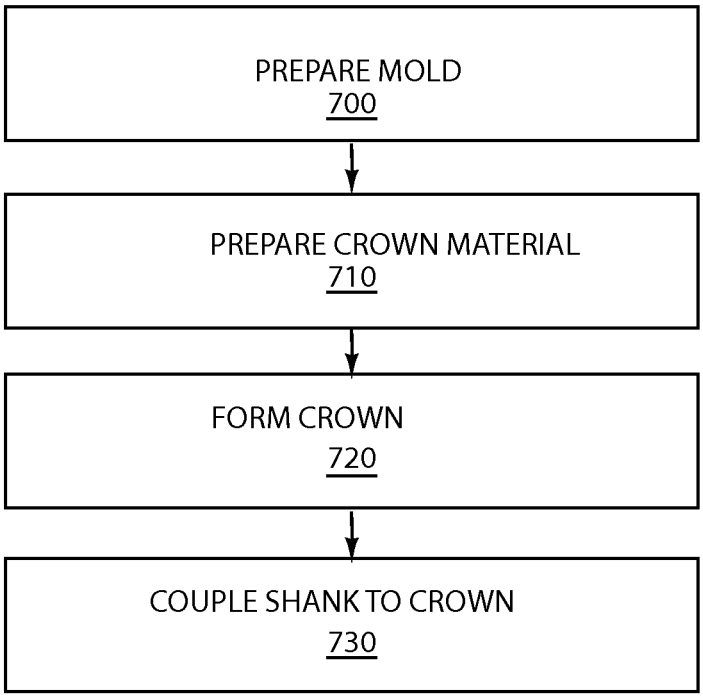
FIG. 7 is a flowchart illustrating a method of forming a drill bit according to one example.

Any suitable method can be used to form drill bits having a face made up of one or more segments in which discontinuous surface features are formed at one or more radial positions on the segments. FIG. 7 illustrates one exemplary method for forming a drill bit. As illustrated in FIG. 7, the method may begin at step 700 by forming a mold. The mold may be formed from a material that is able to withstand the heat to which the drill bit will be subjected to during a heating process. In at least one example, the mold may be formed from carbon. The mold is shaped to form a pattern for the drill bit. Accordingly, the pattern formed in the mold may correspond to the negative of the final shape of the crown. Accordingly, the pattern may define a negative of a crown with the surface features configured as described above. Thus, the crown pattern may define a central axis. The crown pattern may also have a recess defined therein defining a generally planar portion and a plurality of surface feature patterns extending away from the generally planar portion in which the surface features are discontinuous within the segment with respect to a first arced path defined at a first radial distance from the central axis.

Crown material may then be prepared at step 710. The crown may be formed by mixing cutting particles with a matrix material and a binder material. Further, the cutting materials may be mixed with the matrix material and binder material in such a manner that each of the materials is uniformly distributed through the resulting mixture. Any suitable matrix material may be used. Matrix materials may include durable materials, including metallic materials such as tungsten carbide. Similarly, any binder materials may be used, including metallic materials such as copper and copper alloys. The cutting materials may include abrasive materials or other materials that are able to cut an intended substrate. Suitable materials may include diamonds, such as synthetic and/or natural diamonds, including powders of the same.

The crown of the drill bit at step 720 may then be formed by putting the mixture of matrix material and cutting particles into the mold to cover both the surface features and the generally planar surface. Then the material may be pressed into the mold.

Thereafter, at step 730 a shank may be coupled to the crown. In at least one example, a shank may be coupled to the crown by placing the shank in contact with the mold and with the crown in particular. Additional matrix, binder materials, and/or flux may then be added to the mold in contact with the crown as well as the shank to complete initial preparation of the drill bit. Final preparation may optionally include subjecting the heat and/or pressure to finally prepare the bit. Other additional steps may be undertaken as desired as well.

In addition to any previously indicated modification, numerous other variations and alternative arrangements may be devised by those skilled in the art without departing from the spirit and scope of this description, and appended claims are intended to cover such modifications and arrangements. Thus, while the information has been described above with particularity and detail in connection with what is presently deemed to be the most practical and preferred aspects, it will be apparent to those of ordinary skill in the art that numerous modifications including, but not limited to, form, function, manner of operation and use may be made without departing from the principles and concepts set forth herein. Also, as used herein, examples are meant to be illustrative only and should not be construed to be limiting in any manner.

The invention claimed is:

1. A drill bit, comprising:

a crown having a distal portion and defining a central axis, at least one fixed segment formed in the distal portion of the crown, each segment being spaced from the central axis of the crown a predetermined distance and comprising:

a planar portion forming a distal surface, wherein the planar portion of each segment is positioned transverse to the central axis of the crown; and a plurality of surface features continuous with and extending distally away from a portion of the planar portion of each segment, wherein the plurality of surface features comprises at least a first and a second plurality of surface features, wherein the first plurality of surface features are discontinuous and spaced apart within the segment with respect to a first arced path and have a center point defined at a first radial distance from the central axis of the crown, wherein the second plurality of surface features are discontinuous and spaced apart within the segment with respect to a second arced path and have a center point defined at a second radial distance from the central axis, wherein portions of the first and second plurality of surface features radially overlap, wherein the plurality of surface features and at least the planar portion of each segment are integrally formed of a selected matrix material, the selected matrix material comprising a matrix and a plurality of abrasive particles within the matrix, wherein each surface feature of the drill bit consists solely of the selected matrix material, and wherein the matrix of the selected matrix material is configured to erode to expose the abrasive particles within the matrix.

2. The drill bit of claim 1, wherein at least one surface feature of the plurality of surface features is at least partially ellipsoid in shape.

3. The drill bit of claim 2, wherein at least one surface feature of the plurality of surface features is generally hemispherical.

4. The drill bit of claim 2, wherein a major axis of each at least partially ellipsoid shaped surface feature is positioned at an angle with respect to a radian extending from the central axis.

5. The drill bit of claim 1, wherein the abrasive particles of the selected matrix material comprise diamond particles.

6. The drill bit of claim 1, wherein the at least one segment of the crown comprises a plurality of segments, adjacent segments of the plurality of segments being separated by a respective waterway.

7. The drill bit of claim 1, wherein the planar portion and the plurality of surface features of each segment of the crown have a substantially uniform distribution of abrasive particles within the matrix of the selected matrix material.

8. The drill bit of claim 1, wherein the first plurality of surface features have first diameters and the second plurality of surface features have second diameters, the first diameters being greater than the second diameters.

9. The drill bit of claim 8, wherein the first radial distance is smaller than the second radial distance.

10. The drill bit of claim 1, wherein, during rotation of the drill bit, the plurality of surface features of the at least one fixed segment are configured to apply variable contact stresses to a formation.

11. The drill bit of claim 1, wherein the abrasive particles within the matrix of the selected matrix material are configured to cut material of a formation.

12. A drill bit, comprising:

a crown having a distal portion and defining a central axis, the crown comprising:

a first fixed segment formed in the distal portion of the crown and having a planar portion positioned transverse to the central axis of the crown and a plurality of first surface features continuous with and extending distally away from a portion of the planar portion of the first segment, a center point of the plurality of first surface features being positioned at a first radial distance from the central axis, wherein the plurality of first surface features are discontinuous and spaced apart within the first segment with respect to a first arced path defined by the first radial distance, wherein the plurality of first surface features and the planar portion of the first segment are integrally formed of a selected matrix material, the selected matrix material comprising a matrix and a plurality of abrasive particles within the matrix, wherein each surface feature of the first fixed segment consists solely of the selected matrix material; and a second fixed segment formed in the distal portion of the crown and having a planar portion positioned transverse to the central axis of the crown and a plurality of second surface features continuous with and extending distally away from a portion of the planar portion of the second segment, a center point of the plurality of second surface features being positioned at the first radial distance from the central axis, wherein the plurality of second surface features are discontinuous and spaced apart within the second segment with respect to the first arced path defined by the first radial distance, wherein the plurality of second surface features and the planar portion of the second segment are integrally formed of the selected matrix material, wherein each surface feature of the first fixed segment consists solely of the selected matrix material, and wherein the matrix of the selected matrix material is configured to erode to expose the abrasive particles within the matrix.

13. The drill bit of claim 12, further comprising a radial gap defined between the first segment and the second segment.

14. The drill bit of claim 12, wherein the first segment further comprises a plurality of third surface features positioned at a second radial distance from the central axis, the plurality of third surface features being discontinuous and spaced apart within the first segment with respect to a second arced path defined by the second radial distance, the second radial distance being greater than the first radial distance, wherein portions of the plurality of first and third surface features radially overlap.

15. The drill bit of claim 14, wherein the plurality of first surface features have a diameter that is greater than a diameter of the plurality of third surface features.

16. The drill bit of claim 15, wherein the second segment further comprises a plurality of fourth surface features positioned at the second radial distance from the central axis, the plurality of fourth surface features being discontinuous and spaced apart within the second segment with respect to the second arced path defined by the second radial distance.

17. The drill bit of claim 12, wherein, during rotation of the drill bit, the plurality of first surface features and the plurality of second surface features are configured to apply variable contact stresses to a formation.

18. The drill bit of claim 12, wherein the abrasive particles within the matrix of the selected matrix material are configured to cut material of a formation.

* * * * *